US006609923B2

(12) United States Patent
Sato et al.

(10) Patent No.: US 6,609,923 B2
(45) Date of Patent: Aug. 26, 2003

(54) SEMICONDUCTOR DEVICE-SOCKET

(75) Inventors: Masaru Sato, Yokohama (JP); Hiroyuki Kitada, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/179,304

(22) Filed: Jun. 26, 2002

(65) Prior Publication Data

US 2003/0003789 A1 Jan. 2, 2003

(30) Foreign Application Priority Data

Jun. 27, 2001 (JP) ..... 2001-195418

(51) Int. Cl.[7] ..... H01R 13/15

(52) U.S. Cl. ..... 439/259; 439/268; 439/266; 439/264; 439/330

(58) Field of Search ..... 439/259, 261, 439/262, 263, 264, 265, 266, 268, 330, 331

(56) References Cited

U.S. PATENT DOCUMENTS

| | | | | |
|---|---|---|---|---|
| 5,013,256 A | * | 5/1991 | Matsuoka et al. | 439/264 |
| 5,186,642 A | | 2/1993 | Matsuoka et al. | |
| 5,213,531 A | | 5/1993 | Matsuoka et al. | |
| 5,320,550 A | * | 6/1994 | Uratsuji et al. | 439/266 |
| 6,106,319 A | * | 8/2000 | Fukunaga et al. | 439/342 |
| 6,149,449 A | | 11/2000 | Abe | |

FOREIGN PATENT DOCUMENTS

| | | |
|---|---|---|
| JP | 6-30280 | 4/1994 |
| JP | 3059946 | 4/2000 |

* cited by examiner

*Primary Examiner*—Tho D. Ta
(74) *Attorney, Agent, or Firm*—Finnegan, Henderson, Farabow, Garrett & Dunner L.L.P.

(57) ABSTRACT

A semiconductor device-socket is provided, in which the amount of the movement of a contact deviation member 32 is restricted by a protrusion 22P such that a predetermined gap CL1 is formed between a partition wall 32W and a movable contact portion 24A1, and a predetermined gap CL2 is also formed between an outer peripheral surface of the partition wall 32W and a movable contact portion 24A2.

9 Claims, 10 Drawing Sheets

SEMICONDUCTOR DEVICE-SOCKET

This application is based on Patent Application No. 2001-195418 filed Jun. 27, 2001 in Japan, the content of which is incorporated hereinto by reference.

BACKGROUND OF THE INVENTION

1. Field of the Invention

The present invention relates to a semiconductor device-socket used for testing a semiconductor device.

2. Description of the Related Art

Semiconductor devices mounted on an electronic equipment or others are subjected to various tests at a stage prior to being actually mounted so that latent defects therein are removed. The test is performed nondestructively through application of voltage stress, high-temperature operation, and high-temperature storage corresponding to thermal and mechanical environment tests or the like. Among these tests, there is a burn-in test effective for removing initial-inoperable integrated circuits, in which an operation test is performed under a high temperature condition for a predetermined time.

A semiconductor device-socket subjected to such a test as disclosed in Japanese Patent No. 3059946 and as illustrated in FIG. 7, for example, is disposed on a printed circuit board 2 that includes an input/output portion, to which portion a predetermined test voltage is supplied and which portion outputs an abnormality-detection signal representing a short-circuit or others is returned from the semiconductor device as an object to be tested and the abnormality detection signal is transmitted.

The semiconductor device-socket comprises a positioning member 10 including a accommodation portion 10*a* in which a BGA-type (Ball Grid Array) semiconductor device is loaded as the semiconductor device for example; a contact deviation member 8 for supporting the positioning member 10 arranged in a socket body movably as described later in a reciprocating fashion in a predetermined direction and bringing one of contact portion of a contact terminal 16*ai* described later into close proximity to the other of contact or keeping the one away from the other; a socket body 4 for accommodating the contact deviation member 8 relatively movably with respect to a pair of the contact portion of the contact terminal 16*ai*; and a frame member 12 for transmitting operation force acting on itself to the contact deviation member 8 through a driving mechanism of the contact deviation member 8 (not shown).

At a predetermined position on the printed circuit board 2 are formed a group of electrodes connected electrically to the input/output portion through a conductor layer. To the electrode group is connected a terminal 16B on a proximal end side of a plurality of the contact terminals (i=1 to n, n is a positive integer.) provided on the socket body 4 disposed on the printed circuit board 2. Each contact terminal 16*ai*, which is provided corresponding to each electrode portion 6*a* of a mounted semiconductor device 6, comprises a terminal 16B on the side of the proximal end and a pair of movable contact portions 16A1 and 16A2 that are coupled with the just-mentioned terminal 16B for selectively supporting each electrode portion 6*a* of the semiconductor device 6. The pair of the movable contact portions 16A1 and 16A2 approach each other in response to the movement of the contact deviation member 8 to pinch each electrode portion 6*a* of the semiconductor device 6 or are separated from each other to release each electrode portion 6*a* of the semiconductor device 6.

The contact deviation member 8 is disposed movably along the movement direction of the movable contact portions 16A1 and 16A2 of each contact terminal 16*ai* in the accommodation portion 4*a* of the socket body 4. The contact deviation member 8 is coupled to a driving mechanism composed of a pin and a lever as disclosed in Japanese Patent No. 3059946. One end of the lever of the driving mechanism makes contact with an end of the frame member 12. A partition wall portion 8P is provided as a movable contact pressing portion inside of each opening portion where the movable contact portions 16A1 and 16A2 of each contact terminal 16*ai* in the contact deviation member 8 are protruded, which portion 8P is formed so as to divide portion between the movable contact portion 16A1 and the movable contact portion 16A2 of each contact terminal 16*ai*. Further, between the one end of the contact deviation member 8 and an inner peripheral portion of the accommodation portion 4*a* of the socket body 4 is provided a coiled spring 14 as an urging member for urging the contact deviation member 8 oppositely to a direction indicated by an arrow Mo in FIG. 7 to return the contact deviation member 8 to an initial position.

As shown FIG. 8, when the contact deviation member 8 is moved against the urging force of the coiled spring 14 in the direction indicated by the arrow Mo in response to the lowering operation of the frame member 12, the partition wall portion 8P is moved so as to separate the movable contact portion 16A2 of each contact terminal 16*ai* from the movable contact portion 16A1. In contrast, referring to FIG. 9, the contact deviation member 8 is moved owing to the urging force of the coiled spring 14 and the restoring force of the movable contact portion 16A2 oppositely to the direction indicated by the arrow Mo in response to rising operation of the frame member 12.

In such a structure, when the semiconductor device 6 is accommodated in the accommodation portion 10*a* of the positioning member 10 as indicated by a chain double-dashed line in FIG. 7, the frame member 12 is first moved downward. Accordingly, the contact deviation member 8 is moved against the urging force of the coiled spring 14. As shown further in FIG. 8, when the partition wall portion 8P is moved and held such that the movable contact portion 16A2 of each contact terminal 16*ai* is kept away from the movable contact portion 16A1, the electrode portion 6*a* of the semiconductor device 6 is positioned between the movable contact portion 16A1 of each contact terminal 16*ai* and the movable contact portion 16A2 of the same by placing the semiconductor device 6 on the accommodation portion 10*a* of the positioning member 10.

When the frame member 12 is raised as indicated by a solid line in FIG. 7, the contact deviation member 8 is moved to an initial position with the aid of the urging force of the coiled spring 14 and the restoring force of the movable contact 16A2, so that the partition wall portion 8P is separated from the movable contact portion 16A2 and brought into contact with the movable contact portion 16A1.

Accordingly, as shown in FIG. 9, each electrode portion 6*a* of the semiconductor device 6 is pinched with the movable contact portion 16A1 of each contact terminal 16*ai* and the movable contact portion 16A2 of the same to permit each electrode portion 6*a* of the semiconductor device 6 to be electrically connected with each contact terminal 16*ai*.

However, the contact deviation member 8 is moved with the aid of the urging force of the coiled spring 14 and the restoring force of the movable contact portion 16A2 as described above, whereby three partition wall portions 8*p* are separated from the movable portion 16A2, respectively and make contact with the movable contact portion 16A1 for movement to the initial position for example, whereby there happens a situation where some of the movable contacts 16A1 are separated from the electrode portion 6*a*, as illustrated in FIG. 10. There is therefore a possibility that contact pressure between the movable contact portion 16A1 of the contact terminal 16*ai* and the movable contact portion 16A2 of the same is deteriorated and electrical connection is incomplete.

It is contemplated as the cause of the foregoing possibility that a variation in the distance between some of the electrode portions 6*a* of the semiconductor device 6 results from the positional deviation from a reference position.

There might be also contemplated in this situation that position accuracy of the electrode portion 6*a* in the semiconductor device 6 is improved, but it is inadvisable to do so because of a certain limitation.

SUMMARY OF THE INVENTION

In view of the aforementioned with the prior art, it is an object of the present invention to provide a semiconductor device-socket for use in a test for a semiconductor device and which securely achieves electrical connection for an electrode portion without being influenced by variations of position accuracy of the electrode portion of the semiconductor device.

To achieve the above object, a semiconductor device-socket according to the present invention comprises a contact terminal for selectively supporting a terminal of a semiconductor device cooperatively with a plurality of contact portions and electrically connecting the same to a transmission line; a supporting member for supporting a proximal end side of the contact terminal; a contact deviation member disposed movably in the supporting member, the contact deviation member including a press portion between the contact portion of the contact terminal into or out of close proximity to each other following the movement of the press portion; and a position restriction member for restricting the press portion of the contact deviation member at a predetermined gap formed between contact portion sides of the contact terminals when the contact deviation member is moved relatively with respect to the supporting member.

The semiconductor device-socket according to the present invention may be one where it further includes an urging member for urging the contact deviation member in one direction such that a plurality of the contact portions of the contact terminal are brought into the close proximity to each other following the movement of the plurality of the contact portions of the contact terminal.

The socket may be another one where it includes a moving mechanism for moving the contact deviation member in the other direction such that the plurality of the contact portions of the contact terminal are separated from each other following the movement of the plurality of contact portions of the contact terminal.

The position restriction member provided on the supporting member may be a protrusion selectively engaged with the contact deviation member.

The position restriction member provided on the contact deviation member may be a protrusion selectively engaged with a peripheral edge of a recessed portion in the supporting member.

The position restriction member may be a cam member included in the movement mechanism and inserted into a gap between the end of the contact deviation member and the supporting member for moving the contact deviation member.

The position restriction member may be a lever member included in the movement mechanism for interfering the supporting member by relative rotation with respect to the supporting member, the lever member for restricting the movement of the contact deviation member.

The urging member may be a spring member.

A semiconductor device-socket according to the present invention comprises a plurality of contact terminals for selectively supporting a terminal of a semiconductor device cooperatively with a plurality of contact portions and electrically connecting the terminal with a transmission line; a supporting member for supporting a proximal end side of the contact terminal; a contact deviation member disposed movably in the supporting member, the contact deviation member including a plurality of press portions between the contact portion of the contact terminal for bringing the contact portions of the plurality of the contact terminals into or out of close proximity to each other following the movements of the contact deviation, and a position restriction member for restricting the position of each press portion of the contact deviation member at a predetermined gap between the contact portion sides of the contact terminal when the contact deviation member is moved relatively with respect to the supporting member.

In accordance with the semiconductor device-socket of the present invention, as clearly evidenced with the aforementioned description, the position restriction member restricts the position of the press portion of the contact deviation member at a predetermined gap between the contact terminals on the side of the contacts when the contact deviation member is moved relatively with respect to the supporting member, so that electric connection to the electrode portion is securely achieved without being influenced by variations of the positioning accuracy of the electrode portion of the semiconductor device.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
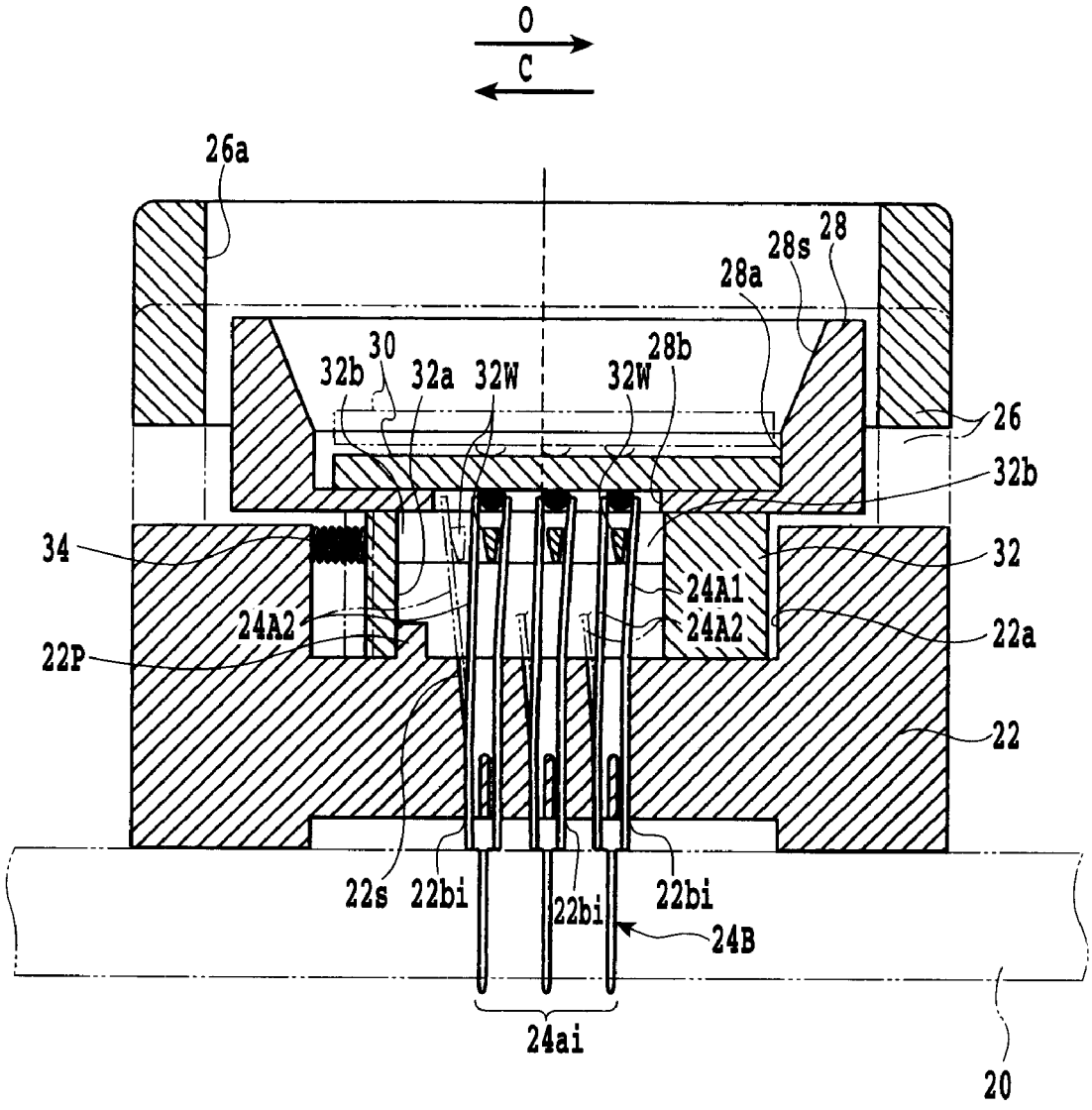
FIG. 1 is a cross-sectional view illustrating a first preferred embodiment of a semiconductor device-socket according to the present invention.

FIG. 1 illustrates a first preferred embodiment of a semiconductor device-socket according to the present invention.

Referring to FIG. 1, a semiconductor device-socket is disposed on a printed circuit board 20 including an input/output portion through which a predetermined test voltage is supplied to and an abnormality-detection signal representing short-circuiting or others is returned from a semiconductor device as an object to be tested and the abnormality-detection signal is transmitted.

The semiconductor device-socket comprises a positioning member 28 that includes a accommodation portion 28*a* in which semiconductor device 30 of a BGA (Ball Grid Array)-type for example as a semiconductor device is positioned and loaded, a contact deviation member 32 disposed in a reciprocating manner in a predetermined direction for supporting the positioning member 28 and for bringing one of movable contact portions of a contact terminal 24*ai* described later into or out of close proximity to the other of movable contact portion, a socket body 22 in which the contact deviation member 32 is accommodated relatively movably with respect to a pair of contact portions of the contact terminal 24*ai* electrically connected to the input/output portion of the printed circuit board 20, and a frame member 26 for transmitting an operation force acting on itself to the contact deviation member 32 through a driving mechanism (not shown) of the contact deviation member 32.

Note that FIG. 1 illustrates a situation which the semiconductor device 30 is loaded in the accommodation portion 28*a* and can be tested.

A plurality of the sockets for semiconductor device are disposed crisscross at a predetermined intervals correspondingly to a group of the electrodes provided on the printed circuit board 20. The input/output portion in the printed circuit board 20 is electrically connected with the group of the electrodes through a conductor layer (not shown).

In the substantially square semiconductor device 30 shaped like a thin sheet, a plurality of the electrodes 30*a* electrically connected with an integrated circuit formed therein are formed at a predetermined intervals on one surface thereof.

The socket body 22 provided on the printed circuit board 20 includes a groove in an outer periphery thereof corresponding to pawls provided on four sides of a frame member 26 (not shown) for guiding movably up or down the each pawl and maintaining the same at predetermined positions. It is noticed that the socket body is not limited to the just-mentioned example, and one may be adopted where such pawls and groove are provided on and in two sides of the frame member 26, respectively.

The socket body 22 includes thereinside the accommodation portion 22*a* for accommodating movably the contact deviation member 32 within the range of a predetermined distance. In a bottom of the accommodation portion 22*a*, through-holes 22*bi* (i=1 to n, n is a positive integer.) are formed, through which the contact terminal 24*ai* (i=1 to n, n is a positive integer.) is inserted and supported. The through-holes 22*bi* are formed at a predetermined intervals corresponding to the electrodes. 30*a* of the semiconductor device 30. One end of the through-hole 22*bi* is opened toward the printed circuit board 20 after penetrating the socket body 22. Around a peripheral edge of the through-hole 22*bi* is formed a slope 22S for guiding the movable contact portion 24A2 of the contact terminal 24*ai* on one internal portion of the contact deviation member 32 on the side in the movement direction of the contact deviation member 32 described later. It is herein noticed that no slope 22S may be formed when the contact terminal 24*ai* is formed of a material that is displaceable with ease.

The contact terminal 24*ai* includes a terminal 24B connected to the printed circuit board 20, and the movable contact 24A1 and the movable contact 24A2 both coupled to the terminal 24B. The movable contact 24A1 and the movable contact 24*a*2, which oppose to each other across a partition wall 32W described later therebetween, are coupled to the terminal portion 24B so as to support the electrode 30*a* of the mounted semiconductor device 30 in corporation therewith, as indicated with a solid line in FIG. 1. The movable contact 24A2 is connected to the terminal portion 24B such that it is brought into or out of close proximity to the movable contact 24A1 toward the moving direction of the contact deviation member 32 described later as indicated by a chain double-dashed line.

Tip ends of the movable contact 24A1 and movable contact 24A2 are protruded from a plurality of the openings 32*b* at an upper portion of the internal periphery 32*a* of the contact deviation member 32 through the same internal periphery 32*a* of the contact deviation member 32, respectively.

The contact deviation member 32 is supported relatively movably in the direction indicated by an arrow C or an arrow O in FIG. 1 with respect to the bottom of the accommodation portion 22*a*. The adjacent openings 32*b* in the contact deviation member 32 are divided by a partition wall (not shown).

In each opening 32*b* is formed a partition wall 32W as the press portion for partitioning between the movable contact 24A1 and the movable contact 24A2. A protrusion 22P is provided on the bottom of the accommodation portion 22*a* as the positioning restriction member selectively engaged with the internal periphery 32*a* of the contact deviation member 32. The protrusion 22P is provided so that a predetermined gap CL1 is formed between the partition wall 32W and the movable contact 24A1 as enlarged illustrated in FIG. 2 when the movement of the contact deviation member 32 is interrupted and hence the movable contact 24A1 and the movable contact 24A2 pinch the electrode 30*a* of the mounted semiconductor device 24A1. At the same time, a predetermined gap CL2 is formed also between an outer periphery of the partition wall 32W and the movable contact 24A2. The gaps CL1 and CL2 are set to values exceeding the supposed amount of positional deviation of the electrode 30*a* of the semiconductor device 30, respectively.

A coiled spring 34 is provided between the internal peripheral surface 22*a* of the accommodation portion 22*a* and the one end surface of the contact deviation member 32 as the urging member for urging the contact deviation member 32 in the direction indicated by an arrow C, i.e., in the direction where the movable contact 24A2 approaches closely the movable contact 24A1.

To an upper portion of the contact deviation member 32 is fixed the positioning member 28. The accommodation portion 28*a* of the positioning member 28 is formed by a wall surface which is opened upward and is continued to the upper end of the contact deviation member 32 through the slope 28*s*. In the bottom of the accommodation portion 28*a* is formed an opening 28*b* where the electrode 30*a* of the semiconductor device 30 is disposed.

Around the positioning member 28 is provided a frame member 26 to be operated so as to surround the positioning member 28. A lower end of the frame member 26 having the opening 26*a* touches an end of a lever member of the moving mechanism (not shown) of the contact deviation member 32. It is herein noticed that a predetermined gap may be formed between the lower end of the frame member 26 and the end of the lever member.

Between the lower end of the frame member 26 and the socket body 22 is provided a return spring (not shown) for urging the frame member 26 upward. Provided that the frame member 26 is raised with the aid of the urging force of the coiled spring 34, the need of such a return spring may be eliminated.

The moving mechanism of the contact deviation member 32 comprises a structure in a specification applied already by the present applicant as disclosed in Japanese Patent Application Publication No. 6-30280 (1994) for example.

In such a structure, in the case where upon the semiconductor device 30 being loaded on the semiconductor device-socket, the semiconductor device 30 held by a robot hand (not shown) is accommodated in the accommodation portion 28*a* of the positioning member 28 through the opening 26*a* as indicated by a chain double-dashed line in FIG. 1 for example, the frame member 26 is first moved downward to a position indicated by the chain double-dashed line in FIG. 1.

Accordingly, the contact deviation member 32 is moved against the urging force of the coiled spring 34 with the aid of the movement mechanism of the contact deviation member 32. Accordingly, when the contact deviation member 32 is moved against the urging force of the coiled spring 34 in the direction indicated by an arrow O, the partition wall 32W presses the movable contact 24A1 against its resilient force and separates the movable contact 24A1 from the movable contact 24A2 as indicated by the chain double-dashed line in FIG. 1.

Then, in the case where the movable contact 24A2 of each contact terminal 24*ai* is separated from the movable contact 24A1 and is held, the semiconductor device 30 is placed on the accommodation portion 28*a* of the positioning member 28, whereby the electrode 30*a* of the semiconductor device 30 is positioned between the movable contact 24A1 and movable contact 24A2 of each contact terminal 24*ai* through the opening 28*b*.

When the frame member 26 is moved upward and is interrupted at a position indicated by a solid line in FIG. 1, the contact deviation member 32 is moved in the direction indicated by the arrow C with the aid of the urging force of the coiled spring 34 and the restoring force of the movable contact 24A2, and then the contact deviation member 32 is interrupted by allowing the protrusion 22P to be engaged with the internal periphery 32*a* of the contact deviation member 32.

Figure 2:
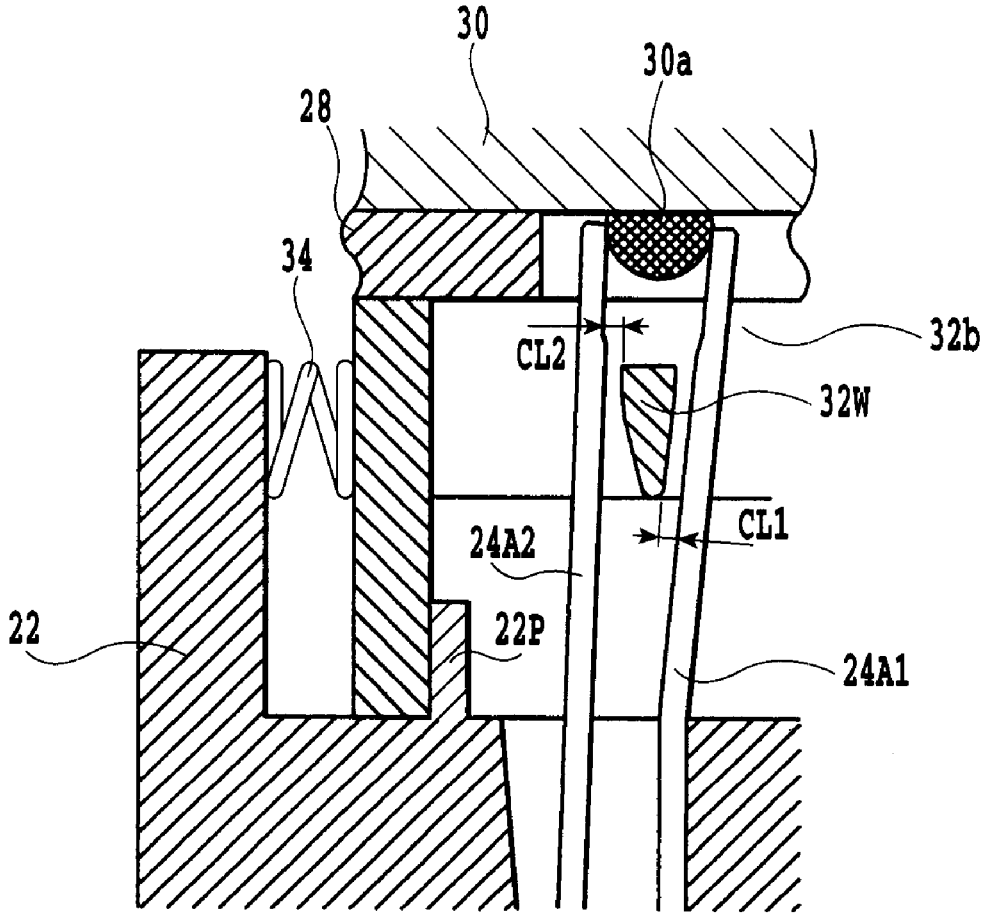
FIG. 2 is a cross-sectional view, partly enlarged, for illustrating the first preferred embodiment in FIG. 1.

Accordingly, as shown in FIG. 2, the predetermined gap CL1 is formed between the partition wall 32W and the movable contact 24A1, and the predetermined gap CL2 is formed between the external peripheral surface of the partition wall 32W and the movable contact 24A2 too, so that it is eliminated that the partition wall 32W causes none of the movable contacts 24A1 and 24A2 to make contact with the electrode 30*a*.

Upon removing the semiconductor device 30 from the socket the frame member 26 is moved downnward again up to the position indicated by the chain double-dashed line in FIG. 1 as described above, and is then held, and the semiconductor device 30 is held and removed with a robot hand (not shown).

Figure 5:
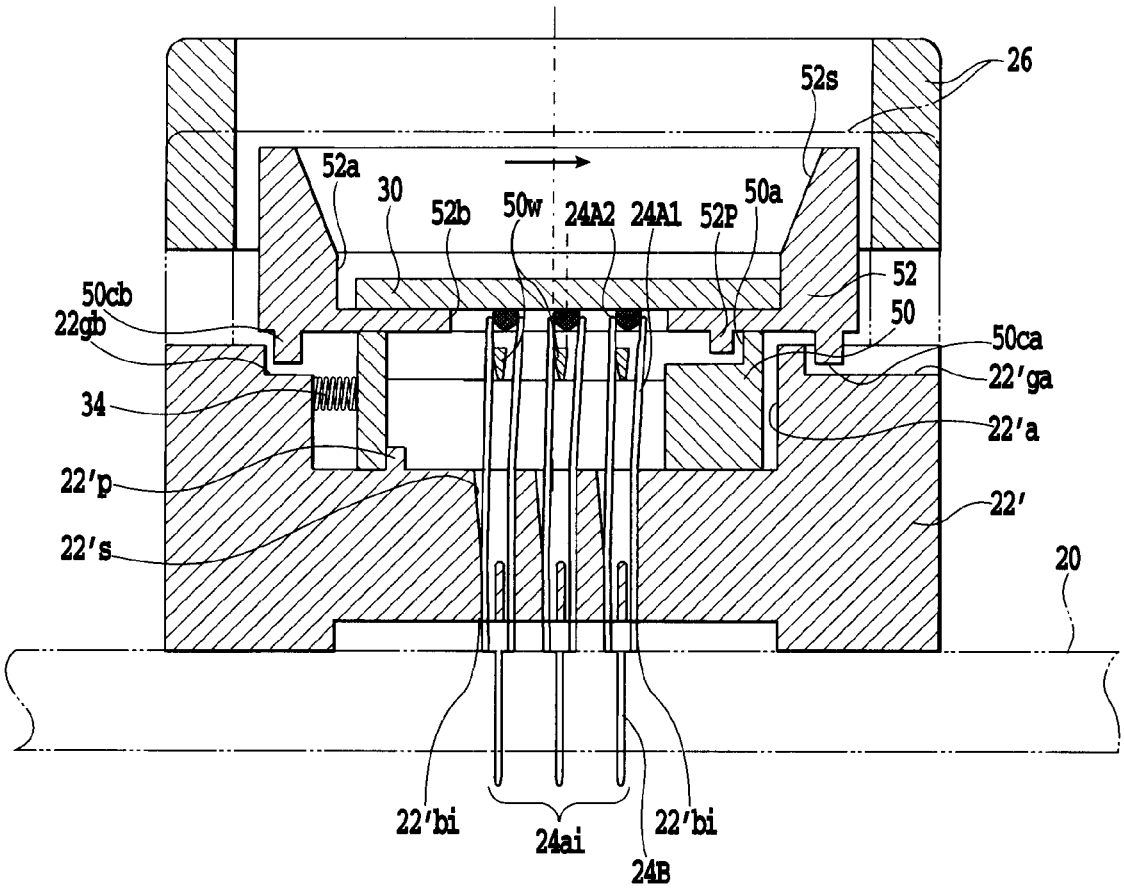
FIG. 5 is a cross-sectional view illustrating a modified one of the first embodiment in FIG. 1.

Although in the foregoing embodiment, the positioning member 28 is fixed to the upper end of the contact deviation member 32, the present invention is not limited to such an example, and as illustrated in FIG. 5 for example a contact deviation member 50 may be disposed in a accommodation portion 22'*a* of a socket body 22' relatively movably with respect to a positioning member 52.

It should be noted that FIG. 5, illustrates the situation where the semiconductor device 30 is loaded in the positioning member 52, in which similar reference numerals are applied to similar elements to those in the example illustrated in FIG. 1, and hence overlapping of the description thereof will be omitted.

The contact deviation member 50 is disposed in the accommodation portion 22'*a* of the socket body 22' movably along the direction of the movements of the movable contacts 24A1 and 24A2 of each contact terminal 24*ai*. The contact deviation member 50 has an opening through which the movable contact portion 24A1 and the movable contact portion 24A2 of each contact terminal 24*ai* are protruded. Each opening is partitioned with a partition wall (not shown).

In each opening through which the movable contacts 24A1 and 24A2 of each contact terminal 24*ai* in the contact deviation member 50 are protruded is provided the partition wall 50*w* as the movable contact press portion that is so formed as to divide a space between the movable contact 24A1 and the movable contact 24A2. Further, between the one end of the contact deviation member 50 and the internal periphery of the accommodation portion 22'*a* of the socket body 22' is provided the coiled spring 34 for urging the contact deviation member 50 to return it to the initial position.

In the upper end of the contact deviation member 50 on which the bottom of the positioning member 52 is placed, is provided a recess 50*a* formed by the wall surface engaged with the protrusion 52P of the positioning member 52 when the contact deviation member 50 is moved in one direction. Accordingly, the contact deviation member 50 is made relatively slidable within a predetermined range with respect to the bottom of the accommodation portion 22'*a* and the positioning member 52, and is moved together with the positioning member 52.

A protrusion 22'P engaged with the internal periphery of the contact deviation member 50, when the contact deviation member 50 is returned to the initial position, is provided on the bottom of the accommodation portion 22'*a* in the same fashion as described in the foregoing example.

This causes the aforementioned action and effect in the same fashion to be ensured.

The positioning member 52 includes at the center thereof the accommodation portion 52*a* on which the semiconductor device 30 is loaded. The internal peripheral surface of the accommodation portion 52*a* is formed by a flat surface on which each end surface of the square semiconductor device 30 touches, and a slope that couples the upper end surface of the accommodation portion 52*a* and the flat surface, and a bottom surface that intersects the flat surface. The size of the internal peripheral surface of the accommodation portion 52*a* is set larger than the size of the external configuration of the semiconductor device 30 loaded with a predetermined tolerance.

In the bottom of the accommodation portion 52*a* is formed an opening 52*b* communicated with the opening in the contact deviation member 50. On a portion of the bottom of the accommodation portion 52*a* opposing to the contact deviation member 50 is formed a protrusion 52P engaged with a peripheral edge of the recess 50*a* in the contact deviation member 50. Further, on the opposite ends of the bottom of the positioning member 52 opposing the socket body 22' are formed protrusions 52*ca* and 52*cb* guided to and restricted by grooves 22'*ga* and 22'*gb* of the socket body 22'.

Figure 6:
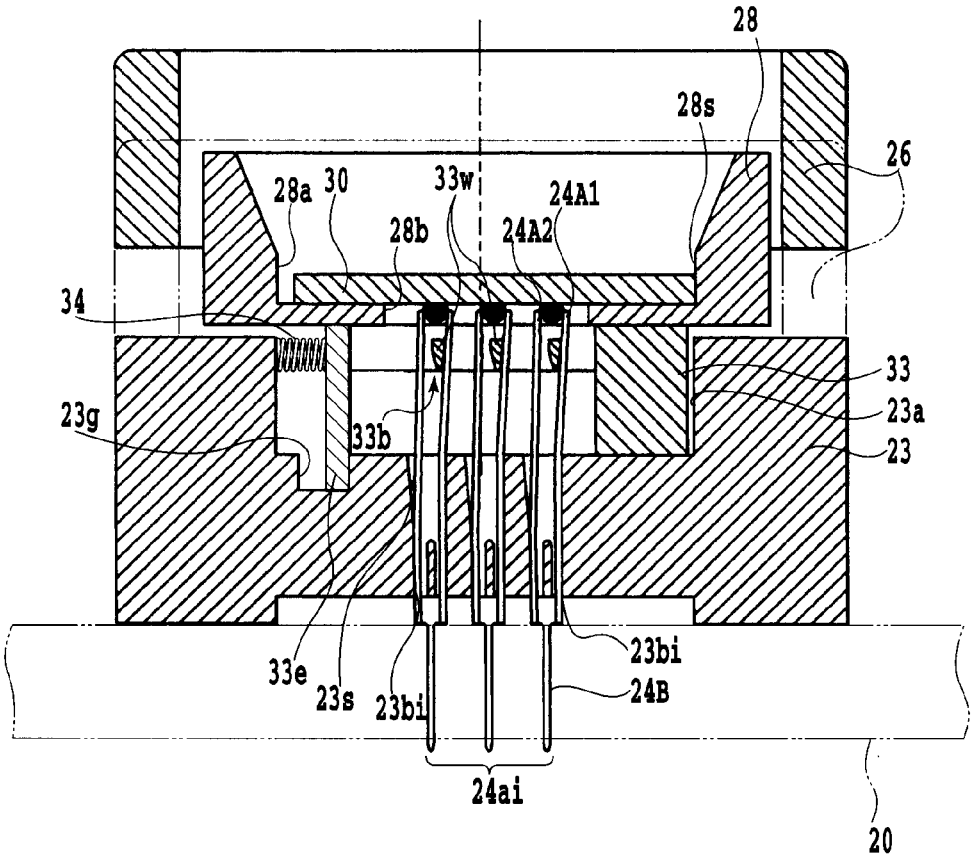
FIG. 6 is a cross-sectional view illustrating another modified example of the modified one of the embodiment in FIG. 1.
Figure 7:
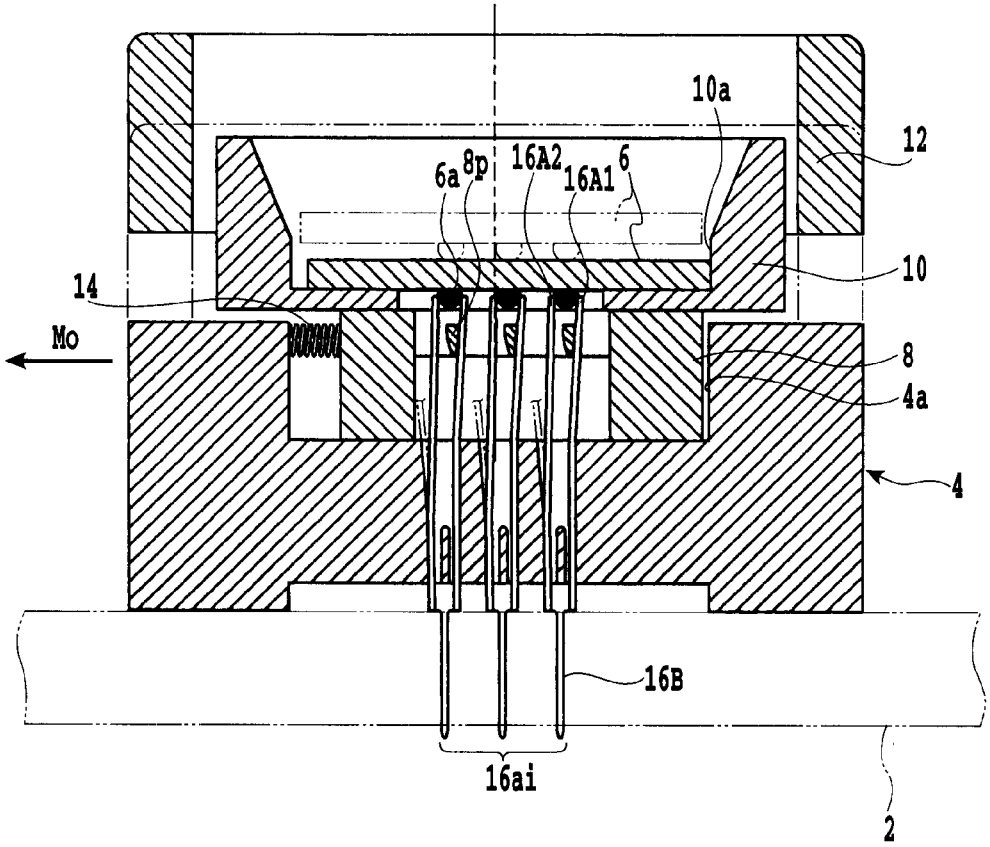
FIG.7 PRIOR ART
FIG. 7 is a cross-sectional view schematically illustrating the arrangement of a prior art semiconductor device-socket.
Figure 8:
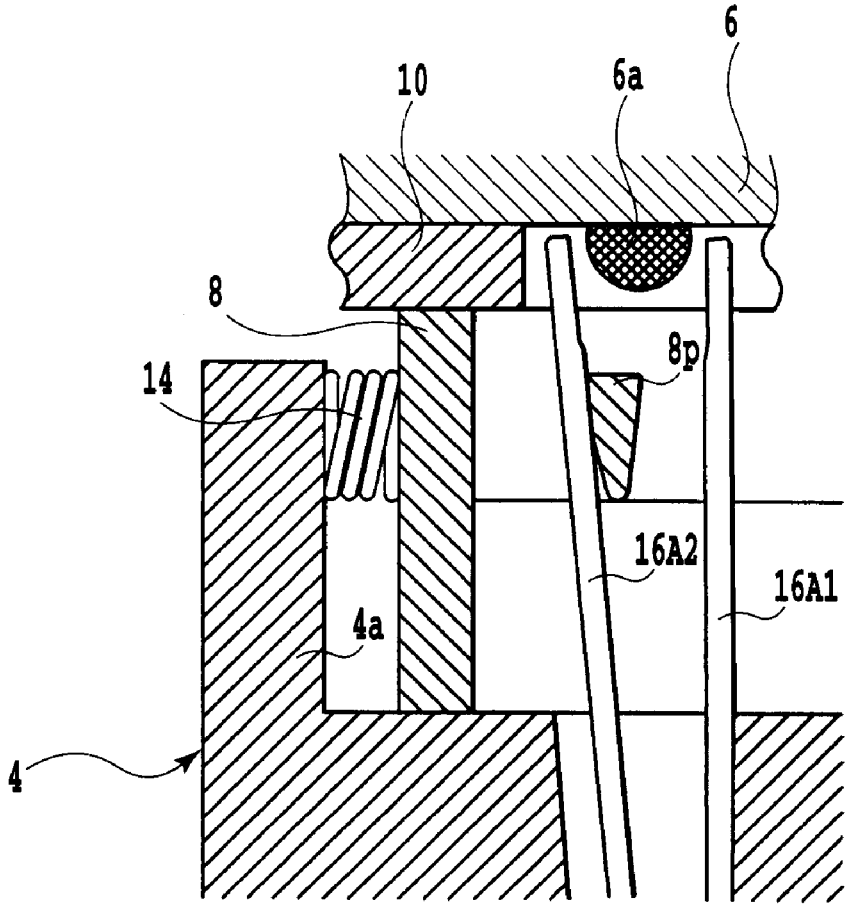
FIG.8 PRIOR ART
FIG. 8 is a cross-sectional view, partly enlarged, for describing the operation of the semiconductor device-socket illustrated in FIG. 7.
Figure 9:
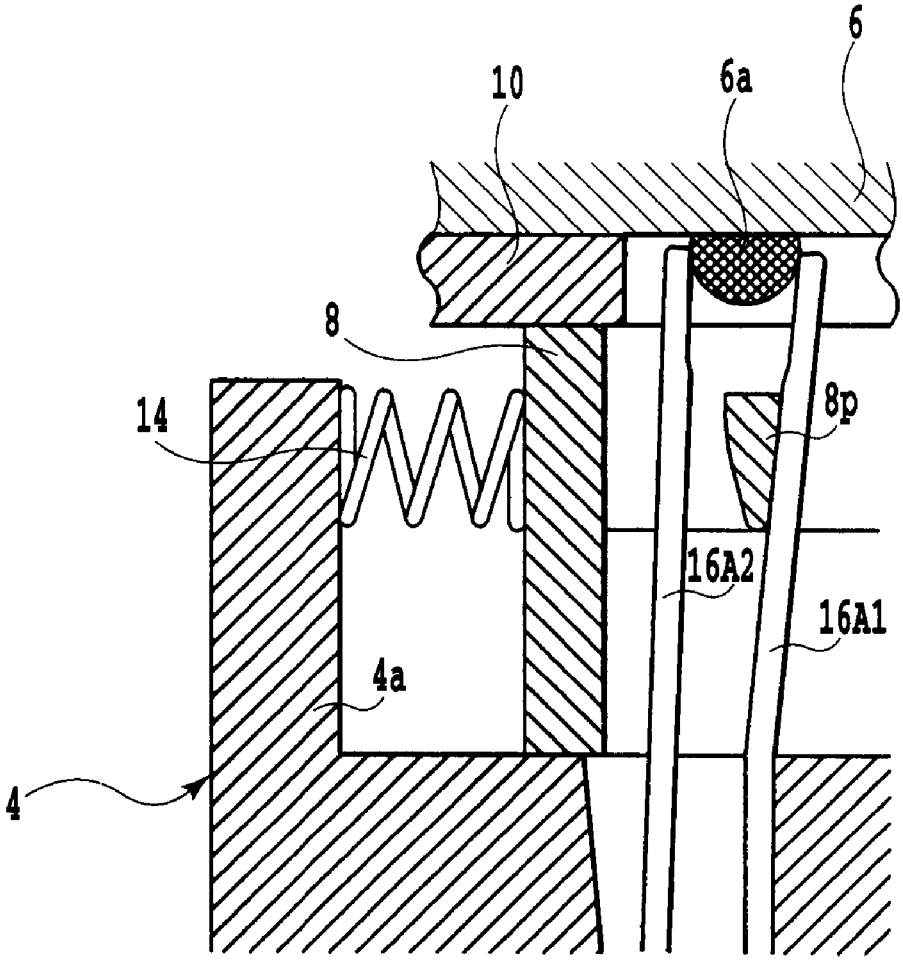
FIG.9 PRIOR ART
FIG. 9 is a cross-sectional view, partly enlarged, for describing the operation of the semiconductor device-socket illustrated in FIG. 7.
Figure 10:
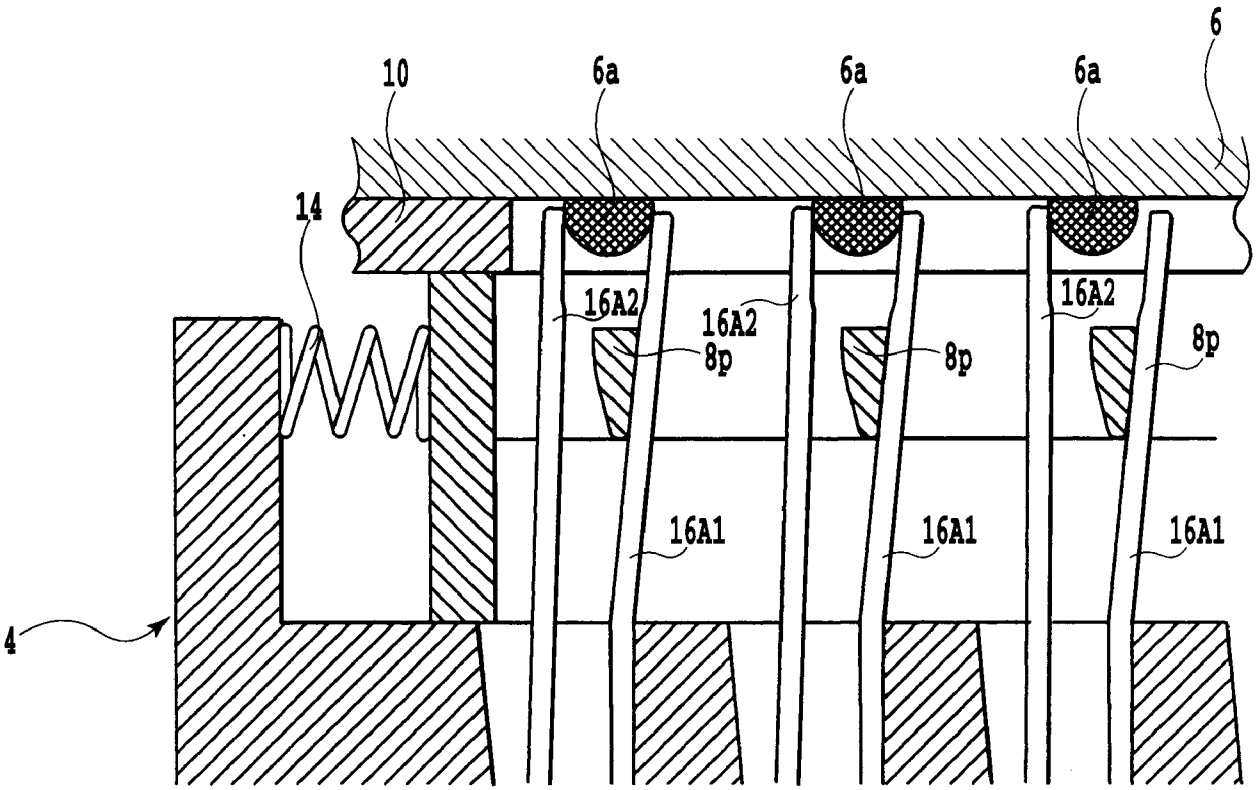
FIG.10 PRIOR ART
FIG. 10 is a cross-sectional view, partly enlarged, for describing the operation of the semiconductor device-socket illustrated in FIG. 7.

Although in the foregoing embodiment illustrated in FIG. 1 the protrusion 22P is provided on the bottom of the accommodation portion 22*a* of the socket body 22, and further the internal periphery of the contact deviation member 32 is selectively engaged with the protrusion 22P for the position restriction, instead of this, it may be allowed that a recessed portion 23*g* is provided at a predetermined position on the bottom of the accommodation portion 23*a* of the socket body 23 as illustrated in FIG. 6, and a contact deviation member 33 has a protruded end 33*e* selectively engaged with a peripheral edge of the recessed portion, whereby a positioning of the contact deviation member 33 may be restricted so that a predetermined gap is formed between the partition wall 33W and the movable contact 24A1 or 24A2 as in the case of the aforementioned example. It is herein noticed that similar reference numerals in FIG. 6 will be applied to the similar components in the example illustrated in FIG. 1, and hence overlapping of the description thereof will be omitted.

The socket body 23 includes the accommodation portion 23*a* thereinside, in which the contact deviation member 33 is movably accommodated within the range of a predetermined distance. There is formed a through-hole 23*bi* (i=1 to n, n is a positive integer.) in the bottom of the accommodation portion 23*a*, through which the contact terminal 24*ai* is inserted and supported. The through-holes 23*bi* are formed at a predetermined interval corresponding to the electrode 30*a* of the semiconductor device 30. One end of the through-hole 23*bi* passes through the socket body 23 and is opened toward the printed circuit board 20. Around the peripheral edge of the through-hole 23*bi* is formed a slope 23S on one internal surface of the contact deviation member 33 on the side of the movement direction of the contact deviation member 33 for guiding the movable contact 24A2 of the contact terminal 24*ai*.

The contact deviation member 33 is supported relatively movably on the bottom of the accommodation portion 23*a*. The adjacent openings 33*b* of the contact deviation member 33 is partitioned with a partition wall (not shown).

In each opening 33*b* is formed a partition wall 33W as the press portion for partitioning between the movable contact 24A1 and the movable contact 24A2. In the bottom of the accommodation portion 23*a* is formed a recessed portion 23*g* that is selectively engaged with an end 33*e* of the contact deviation member 33. The recessed portion 23*g* is provided such that a predetermined gap CL1 is formed between the partition wall 33W and the movable contact 24A1 in the case where movable contact 24A1 and the movable contact 24A2 support the electrode 30*a* of the semiconductor device 30 loaded when the movement of the contact deviation member 33 is interrupted, as enlarged illustrated, in FIG. 2. At the same time, a predetermined gap CL2 is also formed between an outer peripheral surface of the partition wall 33W and the movable contact 24A2. The gaps CL1 and CL2 are set to be values beyond the amount of the positional deviation of the electrode 30*a* of the supposed semiconductor device 30. Positioning member 28 is fixed to the upper end of the contact deviation member 33.

Accordingly, in the present example the same action and effect as those in the foregoing example are therefore achieved.

Figure 3:
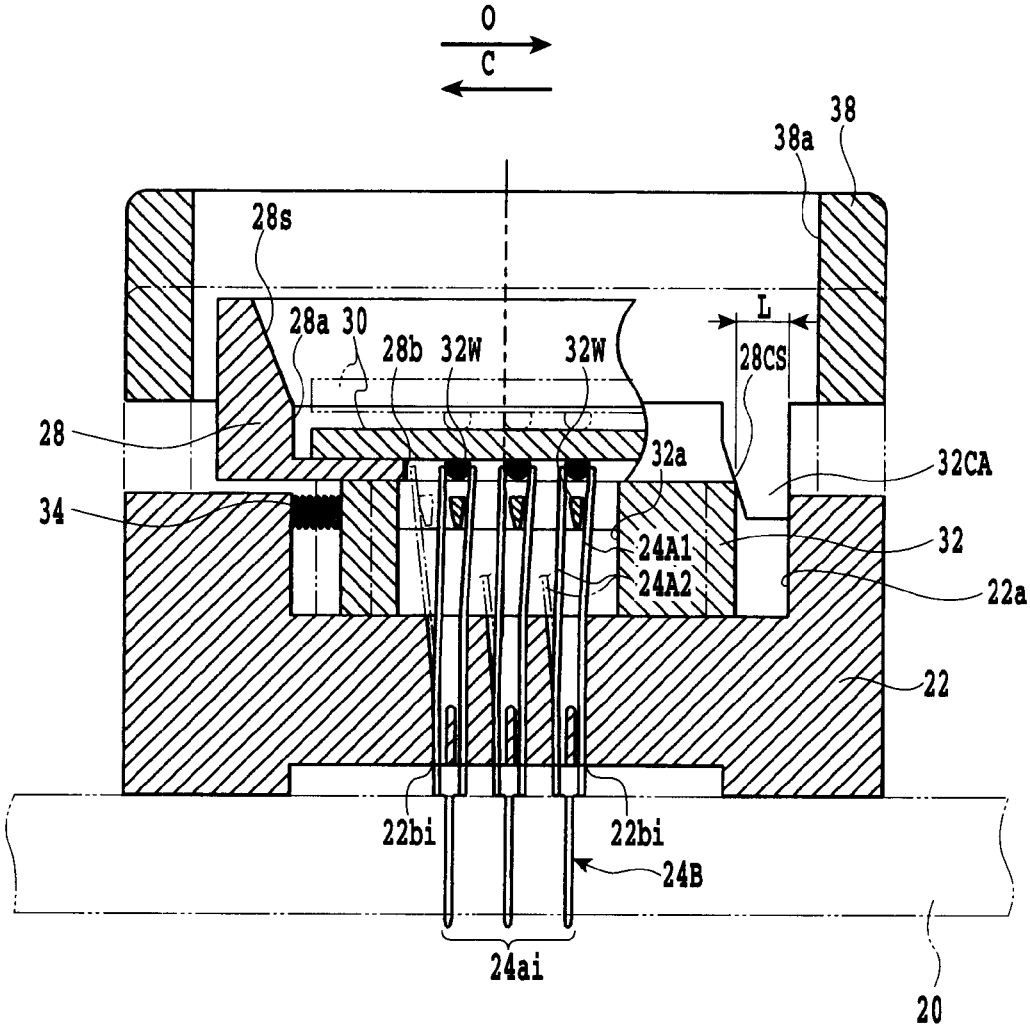
FIG. 3 is a cross-sectional view illustrating a second preferred embodiment of the semiconductor device-socket according top the present invention.

FIG. 3 illustrates a second preferred embodiment of the semiconductor device-socket according to the present invention.

Although in the example illustrated in FIG. 1 the position of the contact deviation member 32 is restricted owing to the protrusion 22P in the accommodation portion 22*a* to form the predetermined gap CL1 between the partition wall 32W and the movable contact 24A1, in the example in FIG. 3 the position restriction for the contact deviation member 32 is instead achieved by a cam 38CA of the frame member 38. FIG. 3 illustrates a situation where the semiconductor device 3 is loaded in the accommodation portion 28*a* of the positioning member 28 and is ready to be tested.

In the example in FIG. 3 and in examples described later, similar reference numerals will be applied to similar components to those constructed in the example illustrated in FIG. 1, and overlapping description thereof will be omitted.

Around the positioning member 28 the frame member 38 to be operated is provided so as to surround it. Between a lower end of the frame member 38 and the socket body 22 there is provided a return spring (not shown) for urging the frame member 38 (not shown) upward. On the lower end of the frame member 38 having the opening 38*a* a cam 38Ca in contact at all times with the internal peripheral surface of the accommodation portion 22*a* and the one end of the contact deviation member 32 is formed, protruded downward.

The tip end of the cam 38CA has been inserted into between the end of the contact deviation member 32 and the internal peripheral surface of the accommodation portion 22*a*.

A slope 38CS having a predetermined gradient is formed at a portion of the cam 38CA opposing the contact deviation member 32. Further, a flat surface in slidably contact with the internal peripheral surface of the accommodation portion 22*a* is formed in a region opposing the internal peripheral surface of the accommodation portion 22*a*.

Referring to FIG. 3, the gradient of the slope 38CS of the cam 38CA is set such that when the frame member 38 is at a highest position, a distance between the end of the contact deviation member 32 and the internal peripheral surface of the accommodation portion 22*a* is a predetermined distance L. The predetermined distance L is set such that when the semiconductor device 30 is mounted on the accommodation portion 28*a* of the positioning member 28, the predetermined gap CL1 is formed between the partition wall 32W and the movable contact 24A1, and the predetermined gap CL2 is formed also between the outer peripheral surface of the partition wall 32W and the movable contact 24A2, as illustrated in FIG. 2 and in the aforementioned description.

In such a structure, upon the semiconductor device 30 being mounted on the semiconductor device-socket 30, in the case where the semiconductor device 30 held by a robot hand (not shown) is accommodated in the accommodation portion 28*a* of the positioning member 28 through the opening 38*a* as indicated by a chain double-dashed line in FIG. 3 for example, the frame member 38 is first lowered up to a position indicated by the chain double-dashed line in FIG. 3.

Accordingly, the contact deviation member 32 is moved against the urging force of the coiled spring 34 with the aid of the slope 38CS of the cam 38CA as indicated by the chain double-dashed line. Therefore, when the contact deviation member 32 is moved against the urging force of the coiled spring 34 indicated by the arrow O, the partition wall 32W presses the movable contact 24A2 against the resilient force of the movable contact, and is separated from the movable contact 24A2 as indicated by the chain double-dashed line in FIG. 3.

In the situation where the movable contact 24A2 of each contact terminal 24*ai* is separated from the movable contact 24A1 and is held, the electrode 30*a* of the semiconductor device 30 is positioned between the movable contact 24A1 of each contact terminal 24*ai* and the movable contact 24A2 of the same by placing the semiconductor device 30 on the accommodation portion 28*a* of the positioning member 28.

When the frame member 38 is raised and is stopped at a highest position indicated by a solid line in FIG. 3, the contact deviation member 32 is moved against the urging force of the coiled spring 34 and the restoring force of the movable contact 24A2 in the direct6ion indicated by the arrow C, and then the contact deviation member 32 is interrupted at a predetermined position owing to engagement of the end of the contact deviation member with the slope 38CS of the cam 38CA.

Accordingly, the predetermined gap CL1 is formed between the partition wall 32W and the movable contact 24A1, and the predetermined gap CL2 is formed also between the outer peripheral surface of the partition wall 32W and the movable contact 24A2, so that it is avoided that the partition wall 32W causes none of the movable contacts to make contact with the electrode 30*a*.

Upon the semiconductor device 30 being removed from the semiconductor device-socket, in the situation where the frame member 38 is lowered up to the position indicated by the chain double-dashed line in FIG. 3 and is then held again as described above, the semiconductor device 30 is held and removed with the aid of a robot hand (not shown).

Figure 4:
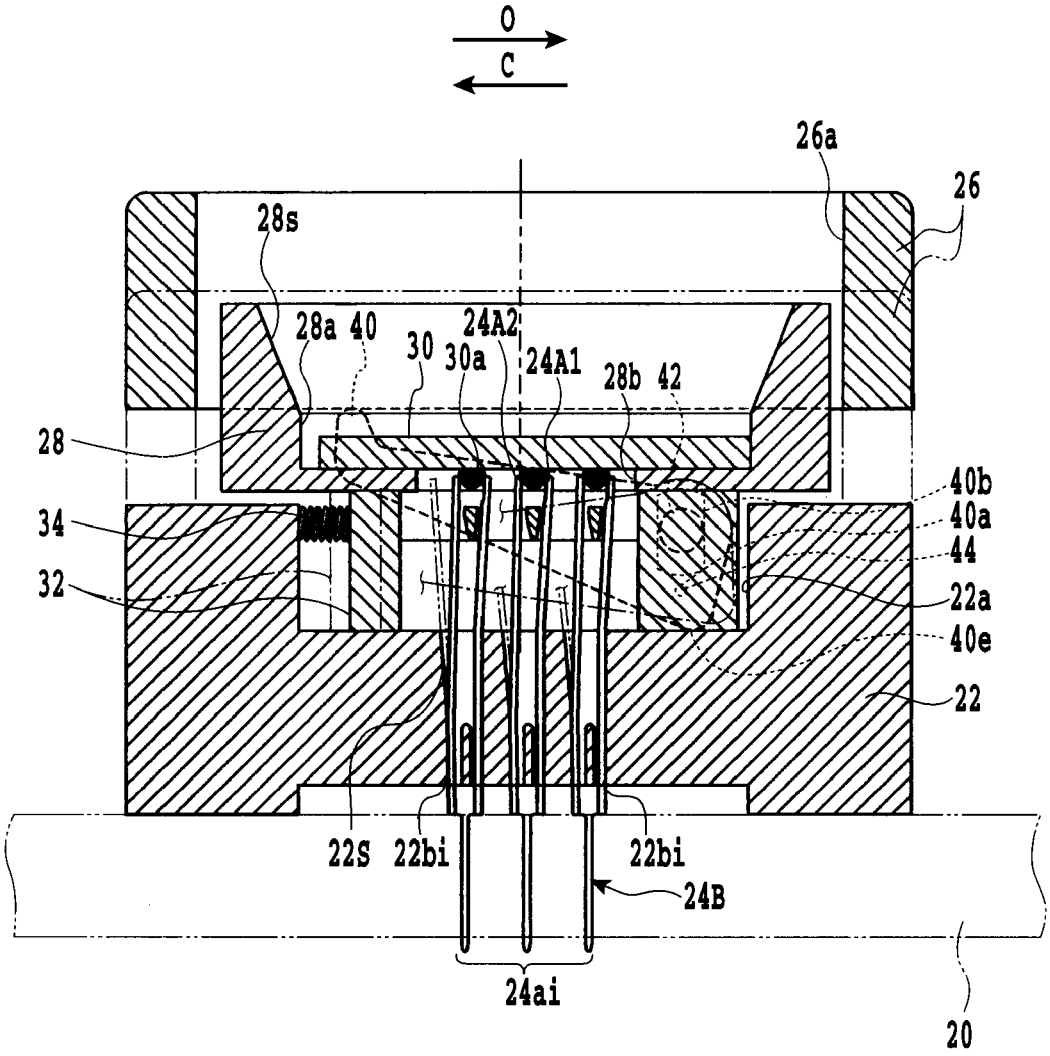
FIG. 4 is a cross-sectional view illustrating a third preferred embodiment of the semiconductor device-socket according to the present invention.

FIG. 4 illustrates a third preferred embodiment of the semiconductor device-socket according to the present invention.

Although the embodiment illustrated in FIG. 1 is adapted such that the predetermined gap CL1 is formed between the partition wall 32W and the movable contact 24A1 by restricting the position of the contact deviation member 32 with the aid of the protrusion 22P in the accommodation portion 22*a*, the embodiment illustrated in FIG. 4 is adapted such that the predetermined gap CL1 9*s* formed between the partition wall 32W and the movable contact 24A1 as illustrated in FIG. 2 instead by restricting the position of the contact deviation member 32 to a predetermined position owing to interfere withnce thereof with the bottom of the accommodation portion 22*a* of the lever member 40.

The lower end of the frame member 26 having the opening 26*a* abuts on the one end of the lever member 40 of the moving mechanism of the contact deviation member 32. Between the lower end of the frame member 26 and the socket body 22 there is provided a return spring for urging the frame member 26 upward, although not illustrated. The other end of the lever member 40 has a transparent hole 40*a* that is supported rotatably in a support shaft 44 provided on the socket body 22. An elongated hole 40*b* is formed in a portion of the lever member 40 adjacent to the transparent hole 40*a*. To the elongated hole 40*b* there is fitted the other end of an engagement pin 42 which has its one end coupled with the contact deviation member 32.

Accordingly, when the frame member 26 is lowered, the lever member 40 is rotated counterclockwise around the support shaft 44, so that the contact deviation member 32 is moved against the urging force of the coiled spring 34 in the direction indicated by the arrow O.

On the one hand, when the frame member 26 is moved upward, the contact deviation member 32 is moved by the urging force of the coiled spring 34 in the direction indicated by the arrow C as the lever member 40 is rotated clockwise around the support shaft 44.

In rotating the lever member 40, when the other end surface 40*e* of the lever member 40 interfere with the bottom of the accommodation portion 22*a* as indicated by a broken line, rotational motion of the lever member 40 is restricted, so that the movement of the contact deviation member 32 is interrupted.

In such a structure, in the situation where upon the semiconductor device 30 being mounted on the semiconductor device-socket, the semiconductor device 30 held by a robot hand (not shown) is accommodated in the accommodation portion 28*a* of the positioning member 28 through the opening 26*a* as indicated by a chain double-dashed line in FIG. 4, the frame member 26 is first lowered up to a position indicated by then chain double-dashed line.

Accordingly, the contact deviation member 32 is moved against the urging force of the coiled spring 34 with the aid of the counterclockwise rotation of the lever member 4 in FIG. 4. Therefore, when the contact deviation member 32 is moved against the urging force of the coiled spring 34 indicated by the arrow O in FIG. 4, the partition wall 32W presses the movable contact 24A2 against the resilience force of the same to separate the same from the movable contact 24A1 as indicated by the chain double-dashed line in FIG. 4.

Subsequently, in the situation where the movable contact 24A2 of each contact terminal 24*ai* is separated from the movable contact 24A1 and is held, the electrode 30*a* of the semiconductor device 30 is positioned between the movable contact 24A1 of each contact terminal 24*ai* and the movable contact 24A2 of the same by placing the semiconductor device 30 on the accommodation portion 28*a* of the positioning member 28.

When the frame member 26 is moved upward to interrupt at a position indicated by a solid line in FIG. 4, the contact deviation member 32 is moved with the aid of the urging force of the coiled spring 34 and the restoring force of the movable contact 24A2 in the direction indicated by the arrow C in FIG. 4, and thereafter the contact deviation member 32 is interrupted by permitting the end surface 40*e* of the lever member 40 rotated clockwise to interfere with the bottom surface of the accommodation portion 22*a*.

Accordingly, as illustrated in FIG. 2 the predetermined gap CL1 is formed between the partition wall 32W and the movable contact 24A1, and the predetermined gap CL2 is also formed between the outer peripheral surface of the partition wall 32W and the movable contact 24A2, so that it is avoided that the partition wall 32W causes none of the movable contacts to make contact with the electrode 30*a*.

Upon the semiconductor device 30 being removed from the semiconductor device-socket, the frame member 26 is lowered up to a position indicated by the chain double-dashed line in FIG. 4, and is then held again as described above, the semiconductor device 30 is held by a robot hand (not shown).

Although in the aforementioned embodiments the contact deviation member 32 and the positioning member 28 are adapted as separate parts, the present invention is not limited to such examples, and the contact deviation member 32 and the positioning member 28 may be constructed in a united manner.

Furthermore, the one example of the semiconductor device-socket according to the present invention may be applied to sockets of the type where no use is made of such a frame member as in the foregoing embodiments.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A semiconductor device-socket comprising:

a contact terminal for selectively supporting a terminal of a semiconductor device cooperatively with a plurality of contact portions and electrically connecting said terminal to a transmission line;

a supporting member for supporting a proximal end side of said contact terminal;

a contact deviation member disposed movably in said supporting member, said contact deviation member including a press portion between said contact portion of said contact terminal for bringing said contact portion of said contact terminal into or out of close proximity to each other following the movement of said press portion; and a position restriction member for restricting the position of the press portion of said contact deviation member at a predetermined gaps formed among said contact portion sides of said contact terminal when said contact deviation member is moved relatively with respect to said supporting member.

2. A semiconductor device-socket as claimed in claim 1 wherein said position restriction member provided on said supporting member is a protrusion selectively engaged with said contact deviation member.

3. A semiconductor device-socket as claimed in claim 1 wherein said position restriction member provided on said contact deviation member is a protrusion selectively engaged with a peripheral edge of a recessed portion in said supporting member.

4. A semiconductor device-socket as claimed in claim 1 wherein it further comprises a moving mechanism for moving said contact deviation member in the other direction such that said plurality of the contact portions of said contact terminal are separated from each other following the movement of the plurality of said contact portions of said contact terminal.

5. A semiconductor device-socket as claimed in claim 4 wherein said position restriction member is a cam included in said moving mechanism and inserted into a gap between an end of said contact deviation member and said supporting member, said cam for moving said contact deviation member.

6. A semiconductor device-socket as claimed in claim 4 wherein said position restriction member is a lever member included in said moving mechanism for interfering said supporting member by predetermined relative rotation with respect to said supporting member, said lever member for restricting the movement of said contact deviation member.

7. A semiconductor device-socket as claimed in claim 1 wherein it further comprises an urging member for urging in one direction said contact deviation member such that said plurality of said contact portions of said contact terminal are brought into the close proximity to each other following the movement of the plurality of said contact portions of said contact terminal.

8. A semiconductor device-socket as claimed in claim 7 wherein said urging member is a spring member.

9. A semiconductor device-socket comprising:

a plurality of contact terminals for supporting terminals of a semiconductor device cooperatively with a plurality of contact portions and electrically connecting the terminal with an electrical transmission line;

a supporting member for supporting a proximal end side of said contact terminal;

a contact deviation member disposed movably in said supporting member, said contact deviation member including a plurality of press portions between said contact portion of said contact terminal for bringing said contact portions of said plurality of the contact terminals into or out of close proximity to each other following the movements of said contact deviation member; and a position restriction member for restricting the position of each said press portion of said contact deviation member at a predetermined gap among said contact portion sides of said each contact terminal when said contact deviation member is relatively moved with respect to said supporting member.

* * * * *